US011351655B1

(12) United States Patent
Samuel

(10) Patent No.: US 11,351,655 B1
(45) Date of Patent: Jun. 7, 2022

(54) ACUTE ANGLE BLADE SHARPENING APPARATUS AND METHOD FOR SHARPENING BLADES

(71) Applicant: Brian Keith Samuel, Central Point, OR (US)

(72) Inventor: Brian Keith Samuel, Central Point, OR (US)

( * ) Notice: Subject to any disclaimer, the term of this patent is extended or adjusted under 35 U.S.C. 154(b) by 942 days.

(21) Appl. No.: 16/115,405

(22) Filed: Aug. 28, 2018

Related U.S. Application Data

(60) Provisional application No. 62/553,752, filed on Sep. 1, 2017.

(51) Int. Cl.

| | |
|---|---|
| ***B24D 15/02*** | (2006.01) |
| ***B24D 15/08*** | (2006.01) |
| ***B24B 3/52*** | (2006.01) |
| ***B24B 3/54*** | (2006.01) |
| ***B24D 15/06*** | (2006.01) |

(52) U.S. Cl.
CPC ..... *B24D 15/084* (2013.01); *B24B 3/52* (2013.01); *B24B 3/54* (2013.01); *B24D 15/02* (2013.01); *B24D 15/065* (2013.01); *B24D 15/08* (2013.01); *B24D 15/081* (2013.01)

(58) Field of Classification Search
CPC ..... B24D 15/02; B24D 15/06; B24D 15/065; B24D 15/08; B24D 15/081; B24D 15/084; B24B 3/52; B24B 3/54
USPC ..... 451/45, 552, 553, 555, 556, 557
See application file for complete search history.

(56) References Cited

U.S. PATENT DOCUMENTS

| | | | | |
|---|---|---|---|---|
| 658,417 | A | 9/1900 | Agesen | |
| 1,172,860 | A | 2/1916 | Aschburner | |
| 3,861,087 | A | 1/1975 | Martin | |
| 3,894,362 | A | 7/1975 | Graves | |
| 4,197,677 | A * | 4/1980 | Graves | B24D 15/06 451/555 |

(Continued)

OTHER PUBLICATIONS

Crock Stick Knife Sharpener, purchased by Applicant 30 years ago in Southern California. Sep. 1988. Attached are photos of the subject sharpener from various angles. Applicant does not recall the specific location or date of the purchase. Also attached is an image of an Idahone V-Type Four Rod Sharpener with Guard, currently for sale from Knife Merchant. Applicant believes that the Crock Stick and the Idahone sharpeners are the same knife sharpener.

*Primary Examiner* — Eileen P Morgan
(74) *Attorney, Agent, or Firm* — Jerry Haynes Law

(57) ABSTRACT

An acute angle blade sharpening apparatus and method for sharpening blades is configured to sharpen the edge and bevel of a blade at the specific acute angles between 21° and 23°, or about 22° and 23°. The apparatus has a base member forming multiple elongated depressions oriented at 22° and 23°. Multiple elongated sharpening members are fixedly mounted in the depressions. The blade is oriented perpendicular to the first side of the base member and drawn against the sharpening members, to engage at the desired 22° and 23° sharpening angles. A leveling instrument attaches to the blade to verify the blade is oriented at the desired angles. A leveling instrument cavity stores the leveling instrument and fastener. Springs retain the sharpening members in the cavity of the base member when not in use. A clamp fastens the base member to a mounting surface for enhanced stability.

18 Claims, 10 Drawing Sheets

(56) References Cited

U.S. PATENT DOCUMENTS

| | | | | | |
|---|---|---|---|---|---|
| 4,231,194 | A * | 11/1980 | Glesser | B24D 15/08 | 451/552 |
| 4,450,653 | A | 5/1984 | Fletcher | | |
| 4,912,885 | A * | 4/1990 | Bonapace | B24D 15/081 | 451/45 |
| 5,195,275 | A * | 3/1993 | McLean | B24B 3/36 | 269/160 |
| 5,458,534 | A | 10/1995 | Campione et al. | | |
| 5,477,753 | A * | 12/1995 | Branscum | B24D 15/08 | 451/552 |
| 7,153,201 | B2 | 12/2006 | Smith | | |
| 8,951,098 | B2 * | 2/2015 | Jhones | B24D 15/081 | 451/45 |
| 9,039,494 | B1 * | 5/2015 | Dovel | B24B 3/54 | 451/349 |
| 9,796,068 | B2 * | 10/2017 | Jhones | B24D 18/00 | |
| 10,744,614 | B1 * | 8/2020 | Allison | B24B 41/066 | |
| 2007/0123155 | A1 * | 5/2007 | Smith | B24D 15/08 | 451/522 |
| 2009/0088057 | A1 * | 4/2009 | Smith | B24D 15/08 | 451/552 |
| 2009/0275272 | A1 * | 11/2009 | Bonapace | B24D 15/082 | 451/321 |
| 2012/0094582 | A1 * | 4/2012 | Lytinas | B24B 3/54 | 451/45 |
| 2014/0113529 | A1 | 4/2014 | Wittenborn | | |
| 2014/0154963 | A1 * | 6/2014 | Jhones | B24D 15/081 | 451/552 |
| 2015/0174723 | A1 * | 6/2015 | Powell | B24B 9/04 | 451/378 |

* cited by examiner

ACUTE ANGLE BLADE SHARPENING APPARATUS AND METHOD FOR SHARPENING BLADES

CROSS-REFERENCE TO RELATED APPLICATIONS

This application claims the benefits of U.S. provisional application No. 62/553,752, filed Sep. 1, 2017 and entitled KNIFE AND SCISSOR BLADE SHARPENING ASSEMBLY AND METHOD FOR SHARPENING BLADES, which provisional application is incorporated by reference herein in its entirety.

FIELD OF THE INVENTION

The present invention relates generally to an acute angle blade sharpening apparatus and method for sharpening blades. More so, the present invention relates to a sharpening apparatus for sharpening the edge and bevel of a blade at the specific acute angles of 22° and 23° by fixedly mounting multiple elongated sharpening members in a base member that forms elongated depression at a first angle of 22° and a second angle of 23°; leveling the blade perpendicular to the base member; drawing the blade against at least one of the sharpening members; and then stowing the sharpening members between springs in the depression in the second side of the base member.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, the effective and safe use of a knife or scissor blade requires occasional sharpening to maintain a keen edge. For a blade which is used at a single location, a sharpening device, such as a whetstone or a sharpening steel can be conveniently stored nearby. Blade sharpening is the process of making a knife blade or similar blade sharp by grinding against a hard, rough surface, typically a stone, or a soft surface with hard particles, such as sandpaper. Additionally, a leather razor strop, or strop, is often used to straighten and polish an edge.

Often, rod blade sharpeners include a holder or stand for rigidly mounting the sharpening rods. Usually the stand is adapted to mount the sharpening rods so that they are inclined from the vertical, at a fixed, predetermined angle. This permits the user to sharpen the cutting edge to a fixed bevel, corresponding to the fixed angle of inclination of the sharpening rods. Such a bevel is usually achieved by pressing the blade against the sharpening rod, with the side of the blade vertical, and drawing it down across the sharpening rod in a single stroke.

Other proposals have involved sharpening rods and their mounts for sharpening blades. The problem with these sharpening rods is that they do not allow the blade to be drawn at the optimal sharpening angles of 22° and 23°. Even though the above cited sharpening rods and mounts meet some of the needs of the market, an acute angle blade sharpening apparatus and method for sharpening blades for sharpening the edge and bevel of a blade at the specific acute angles of 22° and 23° by fixedly mounting multiple elongated sharpening members in a base member that forms elongated depression at a first angle of 22° and a second angle of 23°; leveling the blade perpendicular to the base member; drawing the blade against at least one of the sharpening members; and then stowing the sharpening members in the base member, is still desired.

SUMMARY

Illustrative embodiments of the disclosure are generally directed to an acute angle blade sharpening apparatus and method for sharpening blades. The blade sharpening apparatus is configured to sharpen the edge and bevel of a blade at the specific acute angles of between 21° to 24°, or about 22° and 23° by fixedly mounting multiple elongated sharpening members in a base member that forms elongated depression at a first angle of 22° and a second angle of 23°; leveling the blade perpendicular to the base member; drawing the blade against at least one of the sharpening members.

In some embodiments, the acute angle blade sharpening apparatus comprises a base member having a first side and a second side. The first side forms multiple elongated depressions oriented at a first angle of about 22° and a second angle of about 23° relative to a perpendicular plane which is perpendicular to the plane of the first side of the base member. The second side forms a stowage cavity.

The apparatus provides multiple sharpening members that are defined by a mount end, a body, and a tip. The sharpening members are also defined by a coarse diamond side and a fine steel side. The elongated sharpening members are used to sharpen the blade at a fixed bevel, corresponding to the fixed angle of inclination of the sharpening members. These acute angles allow the blade to be sharpened in multiple ways. The mount end of the sharpening member is detachably affixed into the elongated depressions that form in the base member.

The sharpening members are disposed at an incline from the horizontal, at sharpening angles of about 22° and about 23° relative to a plane which is perpendicular to the typically horizontal plane of the first side of the base member. In this manner, the blade positions perpendicular to the first side of the base member and is drawn against at least one of the sharpening members. The blade and bevel engage at least one of the sharpening members at an angle of 22° or 23°.

In other embodiments, the apparatus provides a leveling instrument that attaches to the blade. The leveling instrument indicates the orientation of the blade relative to the first side of the base member. By maintaining the blade level with the first side of the base member, the blade is ensured to engage the sharpening members at an angle of 22° or 23°.

In other embodiments, the apparatus stows the sharpening members inside the stowage cavity of the base member. The sharpening members are held in the depression of the base member. A plurality of springs on each end of the second side retains the sharpening members in the depression.

In another aspect, the base member is a rectangular block.

In another aspect, the sharpening members are elongated rods.

In another aspect, the sharpening members are fabricated from at least one of the following: steel, carbide, titanium, diamond, metal alloys.

In another aspect, the apparatus further comprises a hand guard hingedly joined with the first side of the base member.

In another aspect, the apparatus further comprises a clamp operable to enable mounting the base member to a mounting surface.

In another aspect, the apparatus further comprises a fastener operable to enable fastening the leveling instrument to the blade.

In another aspect, the fastener is a clip.

In another aspect, the leveling instrument is a spirit level.

In another aspect, the leveling instrument indicates the orientation of the blade relative to the first side of the base member.

In another aspect, the leveling instrument and fastener stow in a leveling instrument cavity that forms in the first side of the base member.

In another aspect, the springs use tension to hold the sharpening members beneath the base member.

One objective of the present invention is to sharpen the edge and bevel of a blade, such as a knife and a scissor blade, with two angled sharpening members at angles of about 22° and 23°.

Another objective is to utilize steel rods or diamond coated rods for sharpening the blade.

Another objective is to form a professional cutting edge for a knife blade or a scissor blade.

Another objective is to sharpen serrated edges; and while this is possible, it is not recommended.

Another objective is to sharpen the blades without removing excess material from the blades, such as with power sharpeners.

Yet another objective is to compactly stow the sharpening members inside the stowage cavity of the base member when not in use.

Yet another objective is to protect the hand from being cut by the blades through use of a hand guard that pivots about the base member, and a clamp that fastens the base member to a mounting surface, such as a table, for hands off sharpening.

Yet another objective is to enable both left and right handed operation of the apparatus.

Yet another objective is to facilitate visually leveling the blade perpendicular to the base member with an attached leveling instrument.

Yet another objective is to sharpen knives and scissors without requiring electrical power.

Yet another objective is to provide an inexpensive to manufacture acute angle blade sharpening apparatus.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 10A shows a sharpening member, FIG. 10B shows a sectioned side view of the base member, FIG. 10C shows a top view of the base member with apertures, and FIG. 10D shows a bottom view of the base member forming a storage cavity with springs that retain the unused sharpening members, in accordance with an embodiment of the present invention.

Like reference numerals refer to like parts throughout the various views of the drawings.

DETAILED DESCRIPTION OF THE INVENTION

Figure 1:
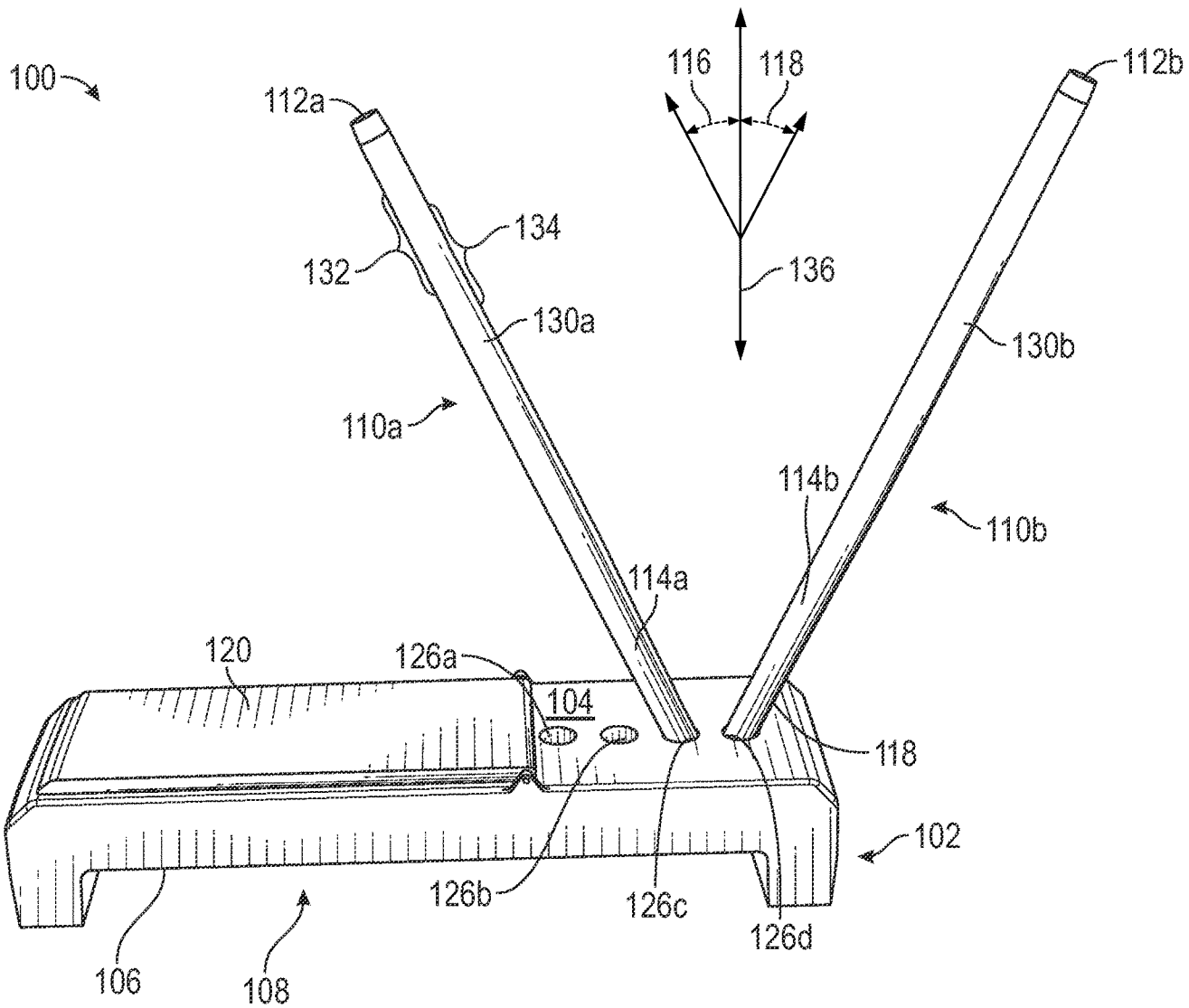
FIG. 1 illustrates a perspective side view of an exemplary acute angle blade sharpening apparatus, showing two sharpening members extending from the base member at a first angle and a second angle, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An acute angle blade sharpening apparatus 100 and method 1100 for sharpening blade is referenced in FIGS. 1-10. The acute angle blade sharpening apparatus 100, hereafter "apparatus 100" is configured to enable manual sharpening of the edge and bevel of a blade 200 at the specific acute sharpening angles 116, 118 of between 21° to 24°, or about 22° and 23°, relative to a perpendicular plane 136 which is perpendicular to the plane of the horizontal mounting surface 202. These acute sharpening angles are shown to provide optimal sharpening for the blade 200 and bevel of a knife, scissor, horticultural cutting blade, and other cutting members.

The apparatus 100 is also unique by providing a leveling instrument 122 that detachably attaches to the blade 200, so as to provide visual verification that the blade 200 is at the optimal first and second angles 116, 118 while being drawn across at least one of the sharpening members 110*a-d*. A hand guard 120 protects the non-sharpening hand while drawing the blade downwardly against the sharpening members with the sharpening hand. A plurality of springs 400*a*, 400*b*, 400*c*, 400*d*, 400*e*, 400*f*, 400*g*, 400*h* retain the unused sharpening members 110*a-b* in a convenient, easy to access manner in the stowage cavity 108 forming under the second side of the base member 102.

As referenced in FIG. 1, the apparatus 100 for sharpening blades is configured to sharpen the edge and bevel of a blade at the specific acute sharpening angles 116, 118 of 22° and 23° with respect to the perpendicular plane 136. The apparatus has a base member forming multiple elongated depressions oriented at a first angle of 22° and a second angle of 23°. Multiple elongated sharpening members 110*a-d* are fixedly mounted in the depressions. The sharpening members 110*a-d* are inclined from the horizontal, at a fixed, predetermined angle. The sharpening members 110*a-d* are configured to sharpen the blade 200 at a fixed bevel, corresponding to the fixed angle of inclination of the sharpening members 110*a-d*.

Figure 2:
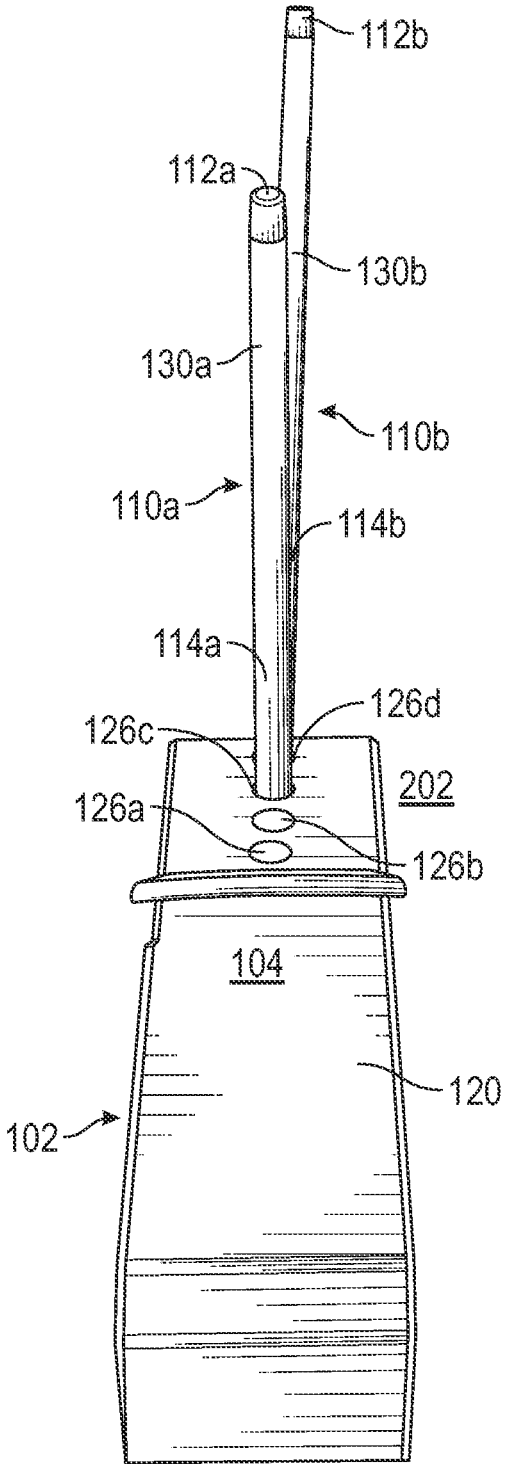
FIG. 2 illustrates a frontal perspective side view of the blade sharpening apparatus shown in FIG. 1, in accordance with an embodiment of the present invention.

Looking now at FIG. 2, the apparatus comprises a base member 102 that provides a stable foundation for the apparatus 100 as the blade 200 is being drawn repetitively across the sharpening members 110*a-d*. In one non-limiting embodiment, the blade 200 is oriented perpendicular to the first side 104 of the base member 102 and drawn against the sharpening members 110*a*, to engage at the desired 22° and 23° sharpening angles. The base member 102 may include a rectangular block that sets firmly on a table or bench, or clamped down to the mounting surface 202 through use of a clamp 700. Though in operation, one hand may be used to hold down the base member 102 while sharpening the blade edge and bevel.

Figure 8:
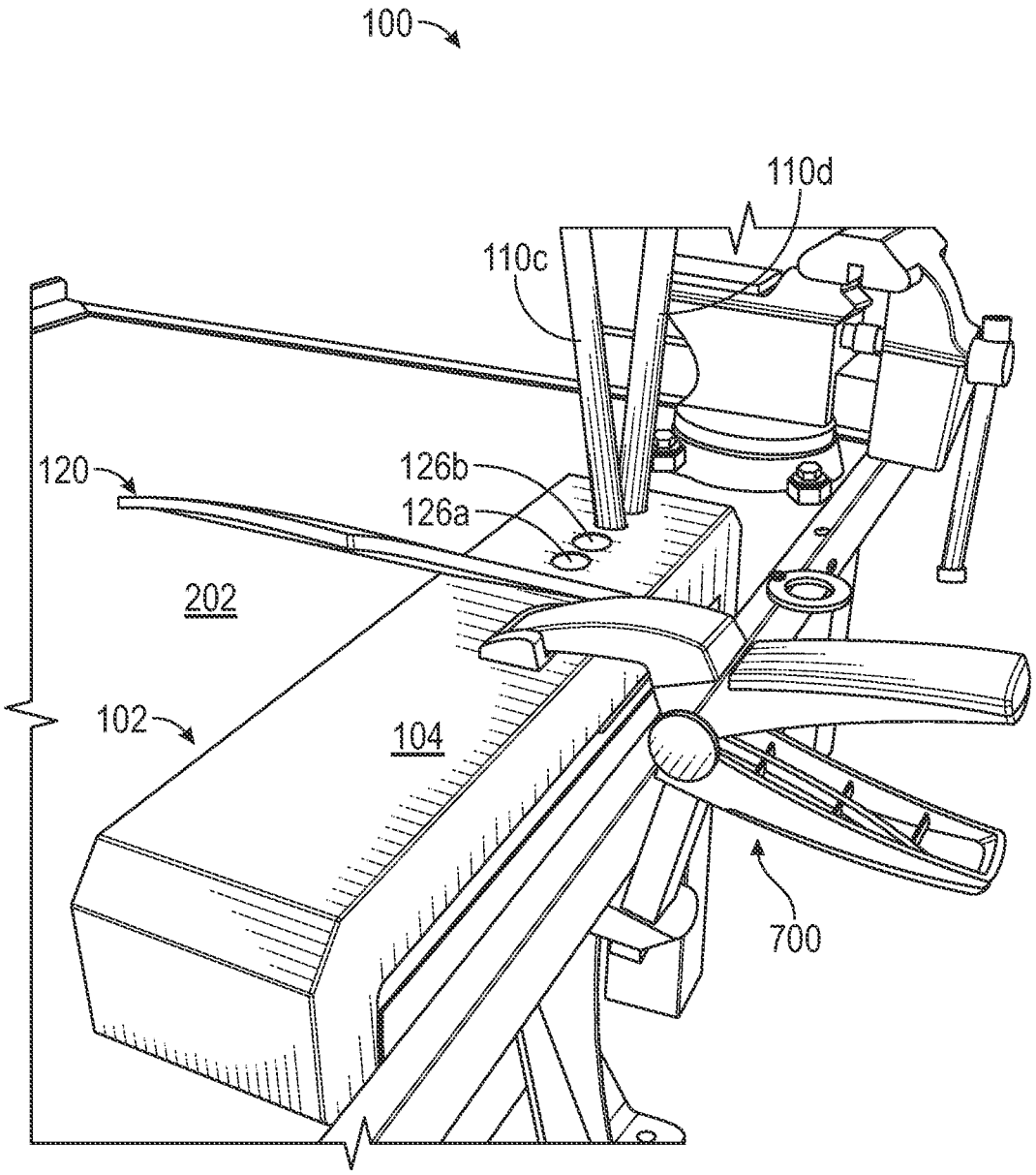
FIG. 8 illustrates a side perspective view of a hand guard on the first side of the base member, and a clamp fastening the base member to a mounting surface, in accordance with an embodiment of the present invention.

The base member 102 comprises a first side 104, facing upwardly towards the user; and a second side 106, engaging the ground surface. The second side 106 may be rubber or have a textured surface for enhanced grip. As shown in FIG. 8, a clamp 700 may be used to fasten the base member 102 to a mounting surface 202, such as a table or bench for further stability. The clamp 700 may be spring loaded and easily manipulated by the opposite hand.

Figure 3:
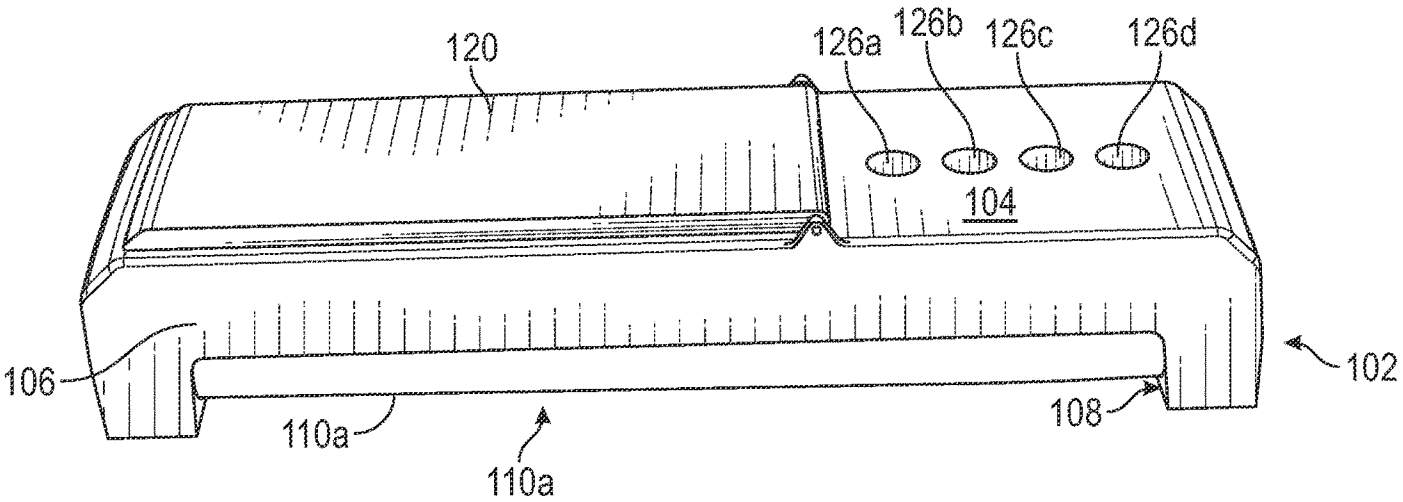
FIG. 3 illustrates a top view of the blade sharpening apparatus, showing the first side of the base member, in accordance with an embodiment of the present invention.
Figure 4:
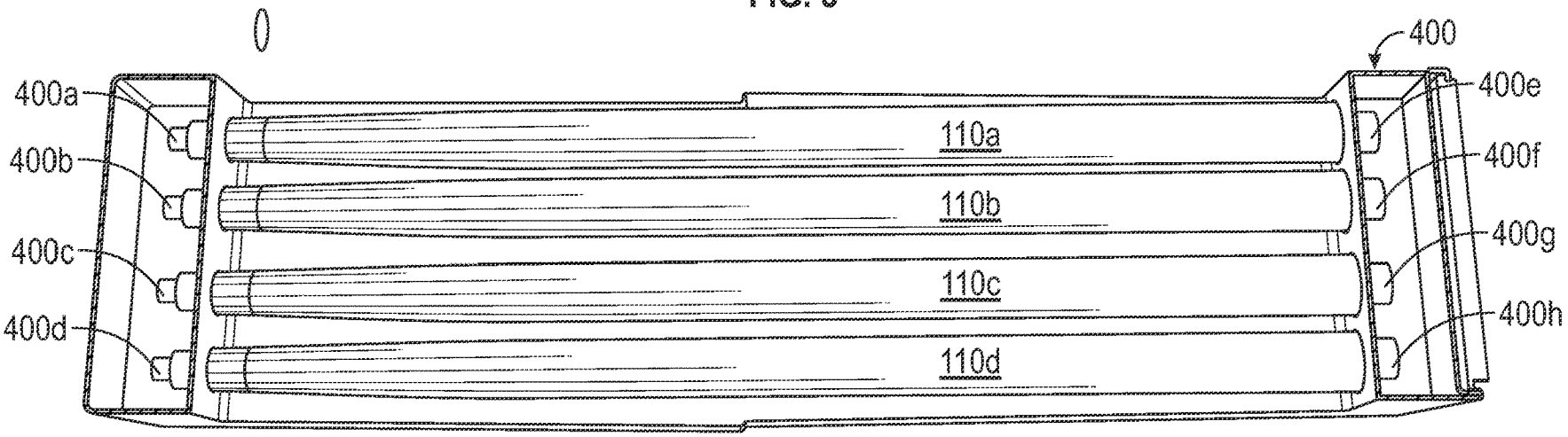
FIG. 4 illustrates a perspective view of springs at the sides of the base member retaining four sharpening members, in accordance with an embodiment of the present invention.
Figure 7:
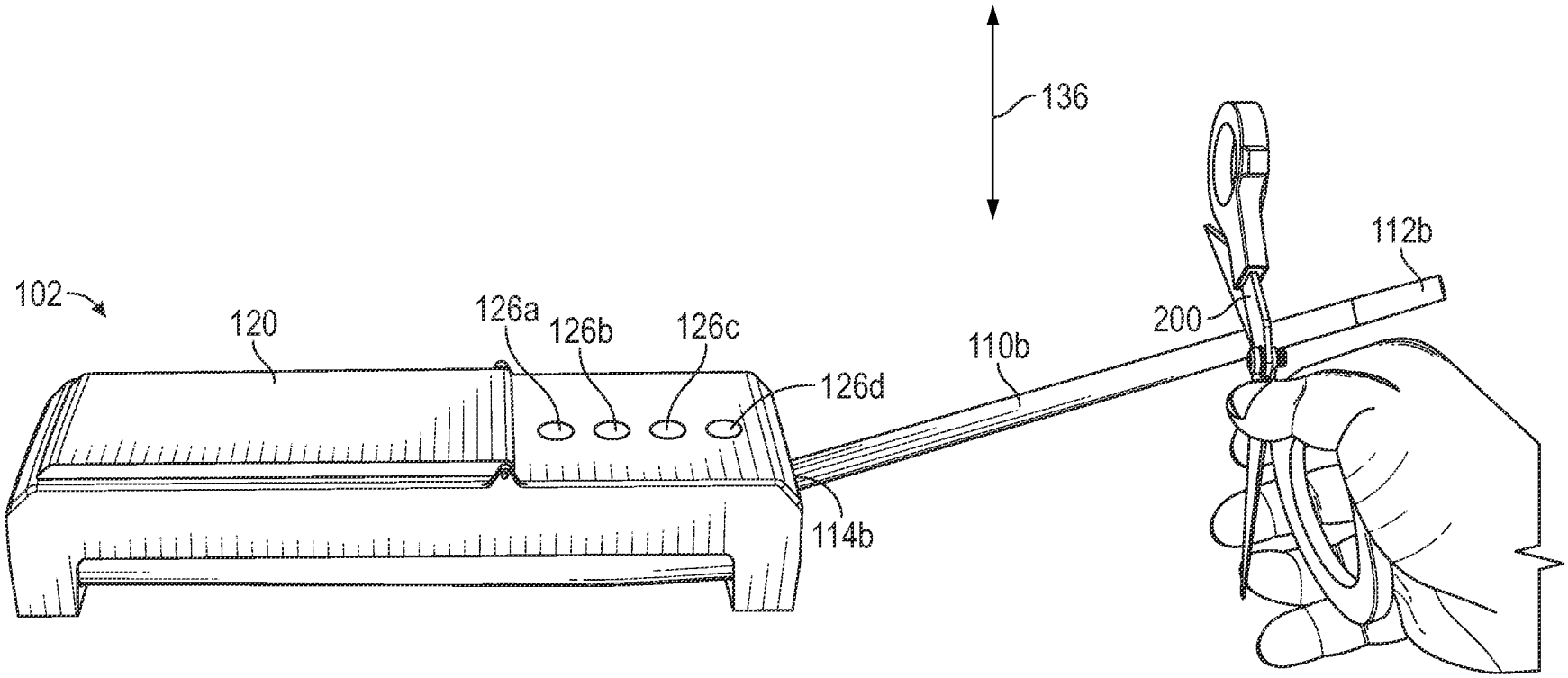
FIG. 7 illustrates a perspective view of the blade sharpening apparatus sharpening a scissor blade with a sharpening member extending from the side of the base member, in accordance with an embodiment of the present invention.

As FIG. 3 show, the first side 104 of the base member 102 forms multiple elongated depressions 126*a-d* that are configured at a fixed predetermined angle of about 22° and 23° relative to the perpendicular plane 136, which is typically perpendicular to the plane of the first side 104 of the base member 102. In one embodiment, four elongated depressions 126*a*, 126*b*, 126*c*, 126*d* form in the first side 104, with each elongated depression having an angle of 22° or 23° with respect to the perpendicular plane 136. Any number of elongated depressions may, however, be formed in the base member 102. The elongated depressions 126*a-d* may also form in the sides of the base member 102. In one alternative embodiment, the sharpening member 110 extends from the sidewall 114*b* of the base member 102 (FIG. 7).

The elongated depressions 126*a-d* are configured to provide a secure anchoring point for the elongated sharpening member 110*a-d*, allowing the sharpening members 110*a-d* to extend from the base member 102 at the 22° or 23° angle relative to the perpendicular plane 136. The angles for each elongated depression 126*a-d* may be different to accommodate the sharpening members 126*a-d* at similarly different angles. This variation in angles is effective for accommodating distinct types of blades and serving different sharpening needs. For example, the depressions 126*a-d* may be oriented at an angle of 20.5°, or 22.5°, or 22°, or 23.5°, or 24°, or 25°.

The second side 106 of the base member 102 provides the surface on which the base member rests on the mounting surface 202. The second side 106 also serves to form a stowage cavity 108. A plurality of springs 400*a-h* or other fastening means may be used to help retain the sharpening members 126*a-d* inside the stowage cavity 108 of the base member.

Looking again at FIG. 2, the apparatus 100 provides multiple elongated sharpening members 110*a-d* that are configured to form an elongated surface for the blade 200 to draw against while being sharpened. The sharpening members 110*a-d* are defined by an elongate body 130 having sufficient length and diameter, so that the blade 200 fully engages, and makes point contact with the entirety of the sharpening members 110*a-d* while being drawn downwardly towards the base member 102. The diameter of the sharpening members 110*a-d* is small enough so that it will make a point contact with the entire cutting edge and bevel of the blade 200 as it is drawn from tip 112*a-d* to base end 114*a-d* of sharpening member 110*a-d*.

In one non-limiting embodiment, sharpening member 110*a* and 110*b* are diamond coated steel rods that are only used at 22° to start sharpening the blades. This material composition is useful for very dull blades. 110*c* and 110*d* are two stage steel rods that rotate 90° to move from a coarse side 132 to a fine side 134. The coarse side 132 starts at 22° and 23°. The fine side 134 is illustrated in 110*c* and 110*d*, and is used at 23° for finished edges. Those skilled in the art will recognize that blade sharpening proceeds in several stages, in order from coarsest to finest. Thus, by rotating the sharpening members 110*c*, 110*d* between coarse and fine surfaces 132, 134, the blade 200 can be sharpened more precisely.

The sharpening members 110*a-d* are also defined by a tip 112*a-d* and an oppositely disposed mount end 114*a-d* that detachably, and snugly, inserts into the elongated depressions 126*a-d*. The mount end 114*a-d* detachably affixes in the angled elongated depressions 126*a-d*. In this manner, the sharpening members 110*a-d* attach at a desired angle during sharpening operations, and detach from the elongated depressions 126*a-d* for stowage in the stowage cavity 108. The sharpening members 110*a-d* are also defined by an elongated body 130*a*, 130*b* having a coarse side 132 and a fine side 134, and a tip 112*a-d* that terminates the sharpening member 110*a-d*.

The sharpening members 110*a-d* are affixed in the elongated depressions 126*a-d* so that they are disposed at a first sharpening angle 116 of about 22°, and a second sharpening angle 118 of about 23°, with both angles being relative to the perpendicular plane 136. Thus, the sharpening members

110*a-d* are disposed at an incline from the horizontal, at sharpening angles of about 22° and about 23° relative to the perpendicular plane 136.

By positioning at these angles, the edges and bevels of the blade 200 are easily sharpened while being longitudinally drawn across the sharpening members 110*a-d*. In this manner, the blade 200 can be sharpened by both the left and right hand without use of electrical power or adjusting the position of the user. Further, the sharpening members 110*a-d* are defined by a coarse side 132 and a fine side 134 that can be rotated 90° to sharpen the blade at the desired side.

In one non-limiting embodiment, the sharpening members 110*a-d* are two ½"×9" round diamond rods set at 22° with respect to the perpendicular plane 136 to align the edge of the blade. In another embodiment, the sharpening members 110*a-d* are two ½"×9" steel rods set at 23° with respect to the perpendicular plane 136 to sharpen the edge of the blade 200. In yet another embodiment, the sharpening members 110*a-d* include a single steel rod set at 25° with respect to the perpendicular plane 136 to sharpen the blade 200.

The simultaneous use of two different sharpening members 110*a-d* allows the blade 200 to be easily sharpened by both the left and right hand. The different sharpening angles also provide different sharpening capacity and work to sharpen different types of blade. Thus, the elongated depressions 126*a-d* are fixed at 22° and 23°, and the angles of the sharpening members 110*a-d* are fixed at 22° and 23°. In this manner, the blade 200 starts sharpening at 22°, and finishes at 23°, so as to catch the leading edge of the blade 200. Also, the apparatus 100 enables both a knife blade and a scissor blade to be sharpened at unique angles, in respect to their differences in edges. For example, a knife blade, which has a different edge than a scissor blade, is tilted slightly to draw against the sharpening member 110*c* at 25° from the coarse side 132.

Looking again at FIG. 1, the sharpening members 110*a-d* are disposed in adjacent angular relationship to each other and in acute angular relation to the plane of the base member 102 and the perpendicular plane 136. Two sharpening members 110*a*, 110*b* may form a generally V-shape from the base member 102. That relationship is such that each sharpening member 110*a-b* performs a proper sharpening action on blade 200 when that blade is held in perpendicular relationship to the base member 102, and is drawn downwardly against the sharpening member 110*a*, from the handle to the tip of the blade 200.

In another embodiment, the sharpening member 110*a-d* is a cylindrical rod that has a diameter small enough to make a point contact with the entire cutting edge of the blade 200 as it is moved downward and from handle to tip. In one embodiment, the sharpening members 110*a-d* includes two thin cylindrical sharpening rods fabricated from steel or diamond composition. Suitable materials for the sharpening members 110*a-d* may include, without limitation, steel, carbide, titanium, diamond, metal alloys.

Figure 9:
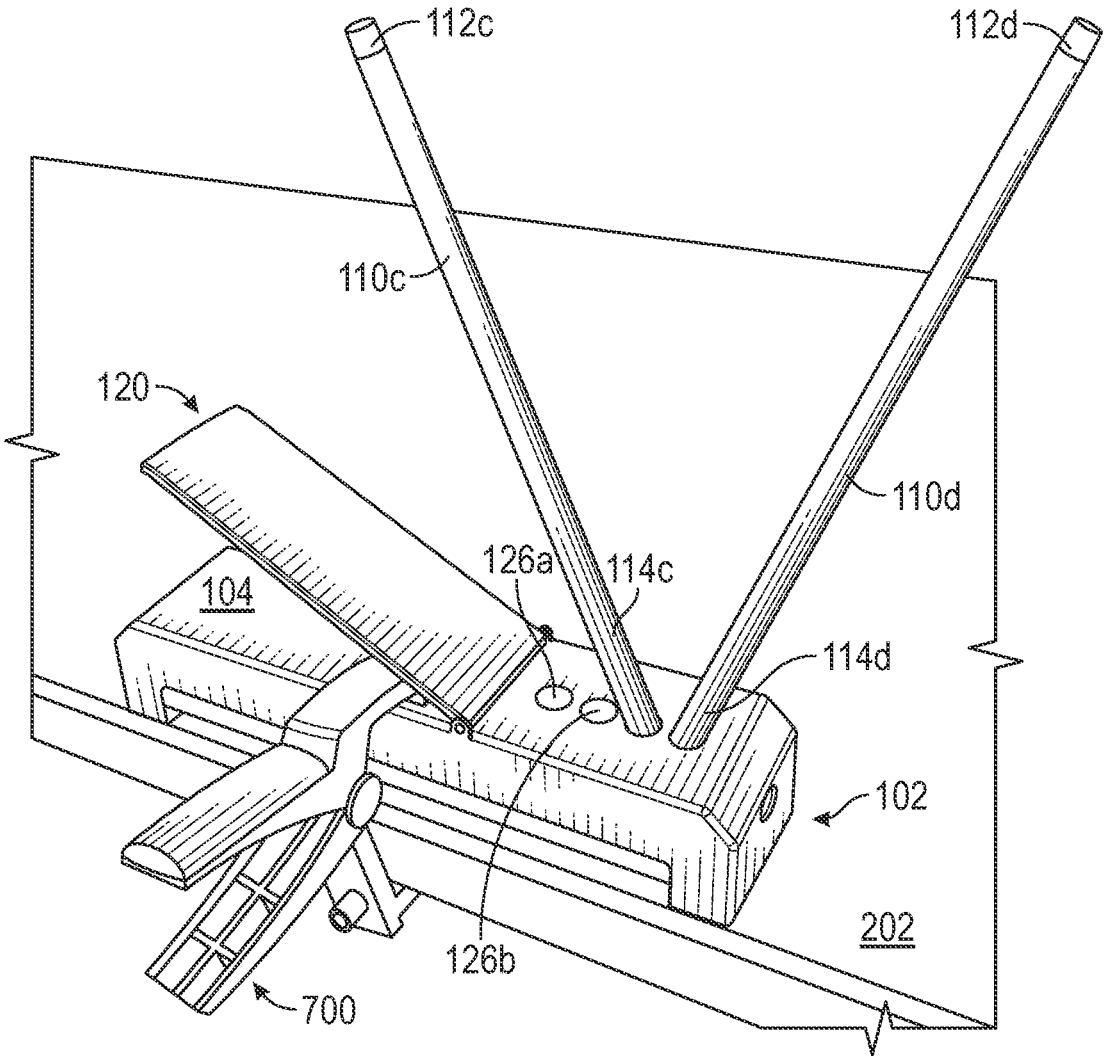
FIG. 9 illustrates an upper angle perspective view of the hand guard and clamp shown in FIG. 8, in accordance with an embodiment of the present invention.

As discussed above, the base member 102 can be pressed down by the hand to provide stability while sharpening. Unfortunately, this may cause the non-sharpening hand to be accidentally cut by blade 200. FIG. 9 references a hand guard 120 that serves as a barrier to protect the hand from being cut by the blades. The hand guard 120 pivots about the first side, serving as a retractable barrier that covers the non-sharpening hand while the sharpening hand draws the blade 200 against sharpening member 110*a*. This helps protect non-sharpening hand from accidentally being cut by blade 200. The user can put the hand beneath the hand guard while pressing down on the base member 102 to provide additional stability while sharpening. In this manner, the blade 200 can be sharpened more efficiently.

Figure 5:
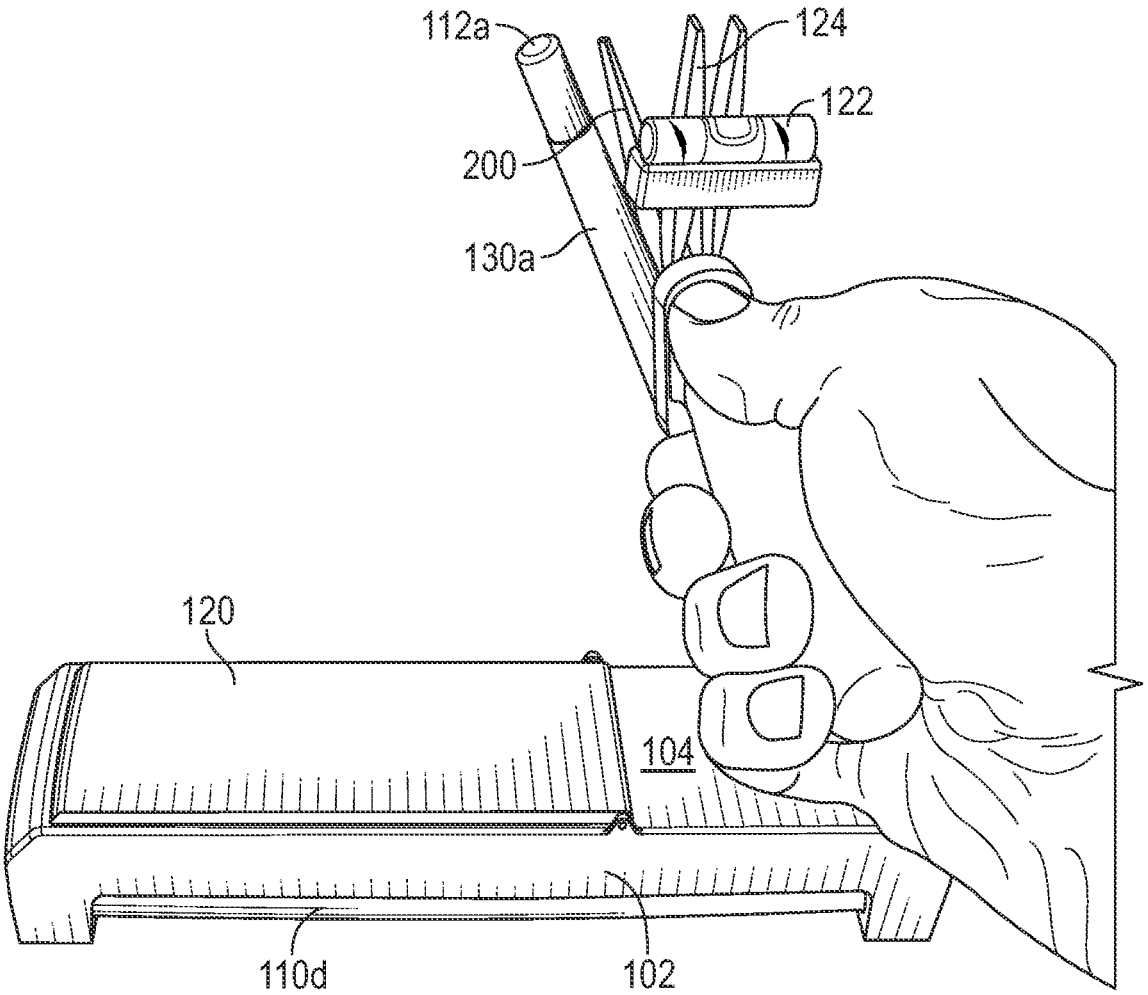
FIG. 5 illustrates a perspective view of the blade sharpening apparatus sharpening a knife blade with a leveling instrument attached, in accordance with an embodiment of the present invention.

As FIG. 5 references, the apparatus 100 also includes a leveling instrument 122 that detachably attaches to the blade 200. The leveling instrument 122 visually indicates that the blade 200 is horizontal; and thereby perpendicular with the first side 104 of the base member 102. The leveling instrument 122 is configured to attach to the blade 200 to help the user maintain the knife at a 90° angle relative to the plane of the first side 104 of the base member 102 while engaging the sharpening members 110*a-d* at their respective angles. If oriented at this angle, the blade 200 is ensured to engage the sharpening members 110*a*, 110*b* at the desired 22° and 23° sharpening angles with respect to the perpendicular plane 136.

The exact angle of the blade 200 is maintained through visual inspection of the leveling instrument 122 while sharpening the blade 200. In this manner, the blades receives optimal sharpening when disposed perpendicular to the first side 104 while engaging the sharpening members at the first and second angles 116, 118 of 22° and 23°. This is because the edges of the blade 200 are sharpened at unique angles, which creates a sharp surface. In one embodiment, the leveling instrument 122 may include a spirit level with a liquid bubble that indicates a horizontal or vertical orientation of the blade relative to the first side of the base member 102.

Figure 6:
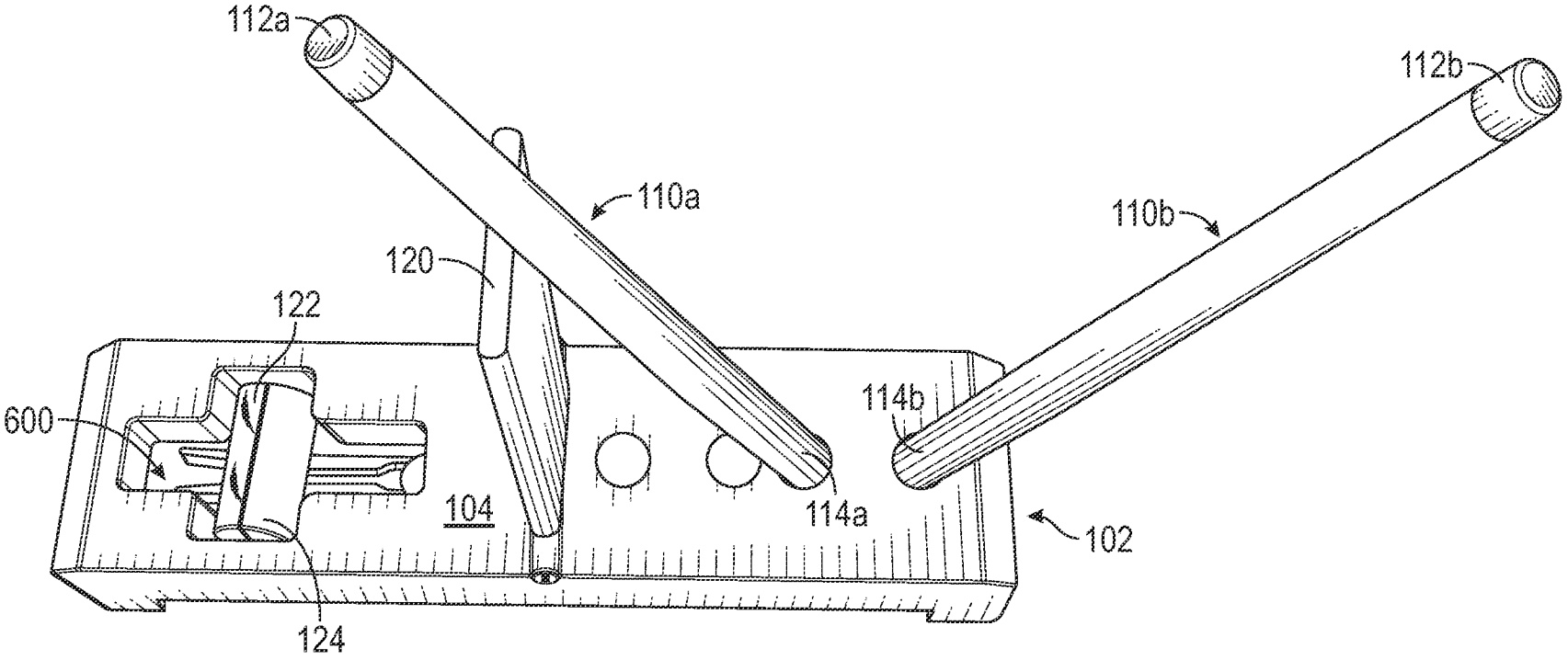
FIG. 6 illustrates a perspective view of the base member storing the leveling instrument and fastener in a leveling cavity, in accordance with an embodiment of the present invention.

As discussed above, a fastener 124, such as a clip, may be used to securely retain the leveling instrument 122 to the blade 200 during sharpening operations. After use, the leveling instrument 122 and the fastener 124 may be stored in the base member 102, similar to the sharpening members. For example, FIG. 6 illustrates a perspective view of the base member 102 storing the leveling instrument 122 and fastener 124 in a leveling instrument cavity 600 formed in the first side 104 of base member 102.

Thus, through the help of the leveling instrument 122, the blade 200 is ensured to be oriented perpendicular to the plane of the first side 104 of the base member and within or parallel to the perpendicular plane 136, while being drawn against at least one of the sharpening members 110*a-d* at the optimal sharpening angle of about 22° and about 23° relative to the first side 104. Further, use of two sharpening members 110*a-d* at the first and second respective angles allows the blade 200 to alternate between each sharpening members 110*a-d* while sharpening, so as to sharpen blade edges and bevels more efficiently.

In operation, the edge or bevel of the blade 200 is drawn in a first direction against a first sharpening member 110*a* while remaining perpendicular to the first side 104 of the base member 102, as shown in FIG. 5. The blade 200 may be pulled while being drawn so that contact of the blade 200 with the sharpening member 110*a* moves progressively from the knife handle toward the tip 112*a* of the blade 200. The diameter of the sharpening members 110*a-d* is small enough so that it will make a point contact with the entire cutting edge and bevel of the blade as it is drawn from tip to base end.

On the first sharpening stroke, the user presses one side of the blade 200, at the point nearest the handle, against the sharpening member 110*a* and draws it down and thereacross. On the second stroke, the opposite side 134 of the blade 200 is pressed against a second sharpening member 110*b* and drawn downwardly thereacross in a similar manner. This longitudinal engagement between blade edges and sharpening members 110*a*, 110*b* is repeated, with opposite sides of the blade 200 sharpened on alternate strokes, until the desired bevel and cutting edge is attained.

It is significant to note that since the sharpening members 110*a-d* are disposed at slightly different angles; the edges are sharpened along greater surface area. Thus, in both strokes, the blade 200 engages the sharpening members 110*a-d* at different angles, so as to optimize exposure to the edge and the bevel of the blade 200. Looking at FIG. 5, the actual sharpening takes place at a point of contact between the blade 200 and the sharpening members 110*a*, 110*b*. The blade 200 are drawn longitudinally and downwardly, so that the point of contact moves smoothly along cutting edges and bevels of the blade 200. Further, FIG. 7 illustrates a sharpening member extending from the side of the base member to sharpen a scissor blade. The edge and bevel of the scissor blade is different than the knife blade, but is still sharpened between 21° to 24°.

Turning again to FIG. 5, a knife blade is held at the same perpendicular orientation relative to the first side 104 of the base member 102. The knife blade is, however, drawn against a sharpening members 110*c* that is oriented at 25° relative to the perpendicular plane 136. In the case of a scissor blade, the sharpening member 110*c* may extend from a side surface of the base member 102 at the steeper 25° angle. This different sharpening angle is effective for sharpening different types of blades because the first and second angles 116, 118 do not require the knife blades to have as many sharp surface points as the scissor blade. The apparatus 100 also provides a plurality of springs 400*a-h* that retain the sharpening members 110*a-d* when not being used to sharpen blade 200.

Figure 10A:
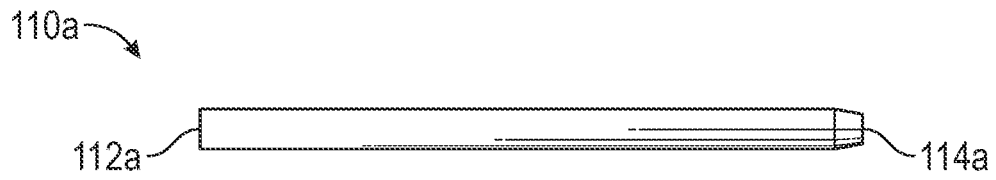
FIGS. 10A-10D illustrate views and dimensions of components of the acute angle blade sharpening apparatus, where

The apparatus 100 is also unique in that it is scalable. This allows for home kitchen use, and large scale industrial use, such as in a slaughter house. The apparatus 100 accommodates any function that requires sharpening blades. FIGS. 10A-10D illustrate views and dimensions of components of the apparatus 100. FIG. 10A shows a side view of an exemplary sharpening member. Here, the sharpening member is shown to have a length of about 9" and a diameter of about ½". Though in other embodiments, other sizes and shapes may be used.

Figure 10B:
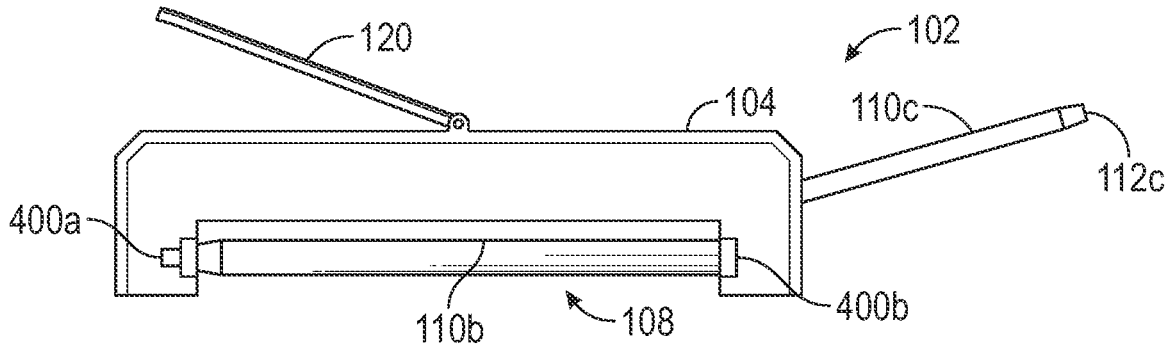
Figure 10C:
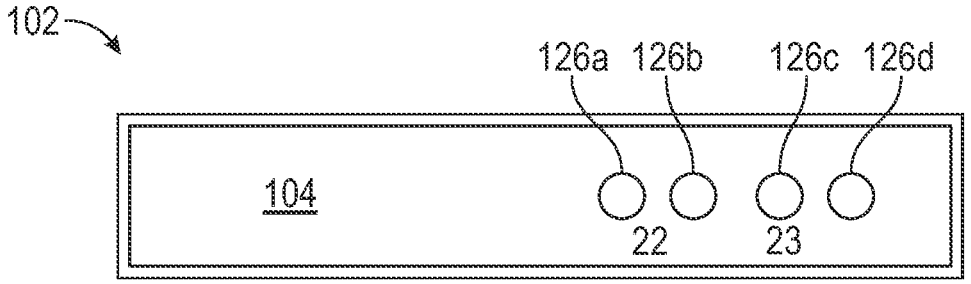
Figure 10D:
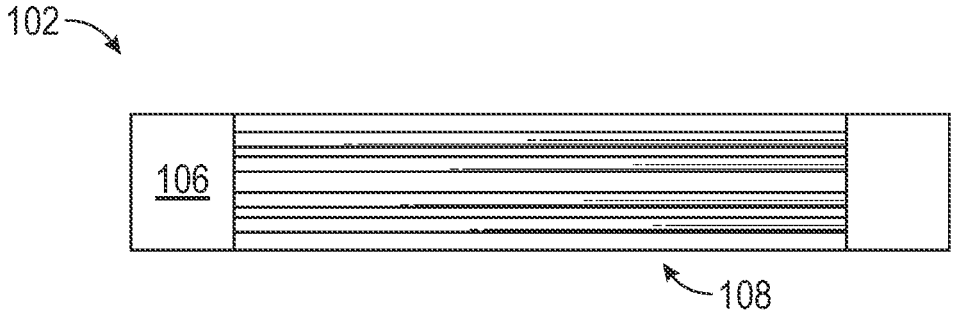

Continuing now with FIG. 10B, a sectioned side view of the base member illustrates the springs in the depression of the base member. The springs may be ¼" long and have a ¼" diameter. The base member may be 8½" long, 2" in height, and having elongated depressions 126*a-d* with a diameter of about ¼". Though in other embodiments, other sizes and shapes may be used. FIG. 10C shows a top view of the base member with elongated depressions 126*a-d*. Continuing, FIG. 10D shows a bottom view of the base member 102 forming a stowage cavity 108 with four sets of springs 400*a-h* on each side of base member for retaining the sharpening members when not in use. Though in other embodiments, different numbers of springs may be used.

Figure 11:
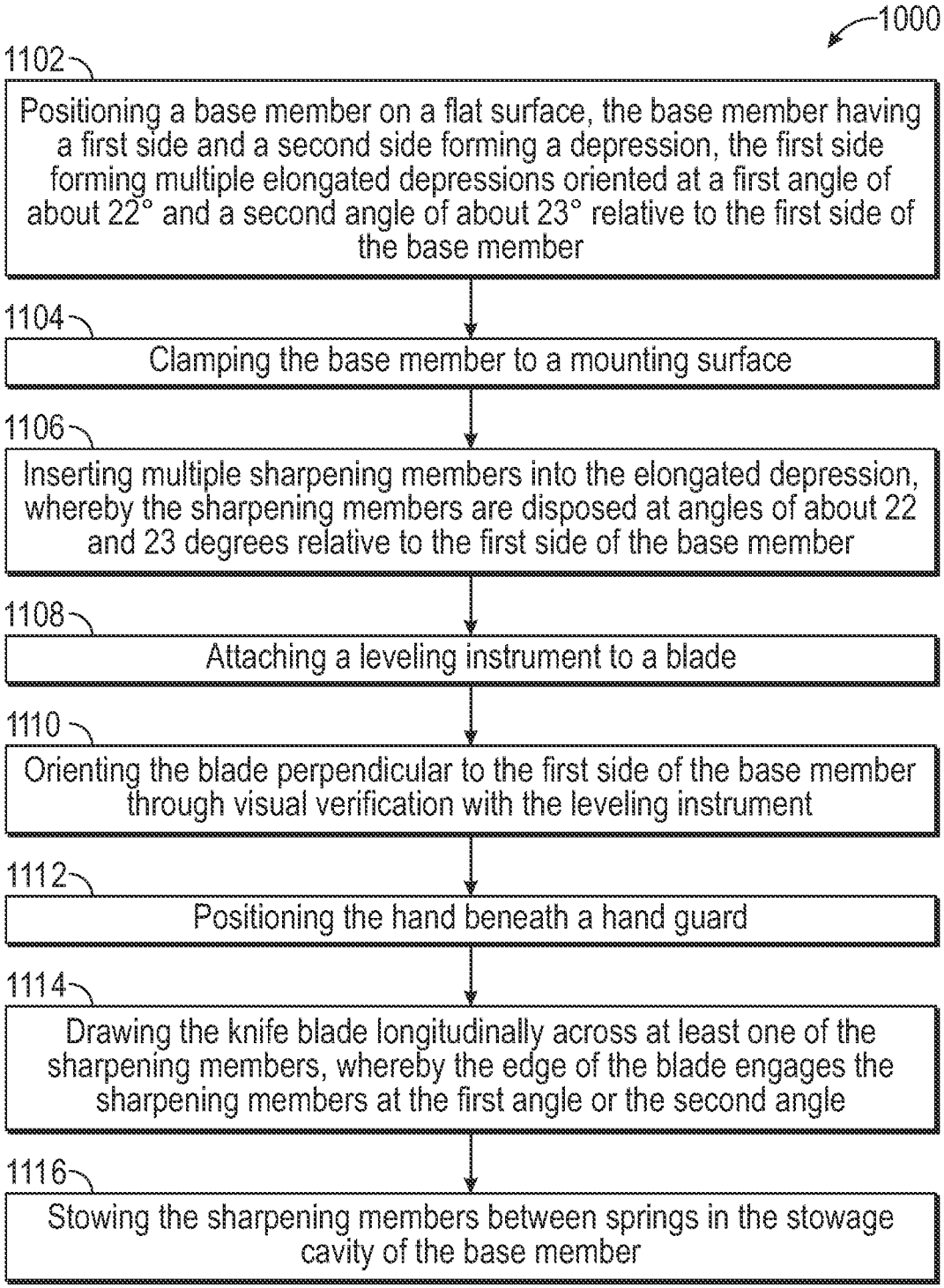
FIG. 11 illustrates a flowchart of an exemplary method for sharpening a blade, in accordance with an embodiment of the present invention.

FIG. 11 illustrates a flowchart of an exemplary method 1100 for sharpening a blade. The method 1100 may include an initial Step 1102 of positioning a base member on a flat surface, the base member having a first side and a second side forming a stowage cavity, the first side forming multiple elongated depressions oriented at a first angle of about 22° and a second angle of about 23° relative to the perpendicular plane 136. The base member provides the foundation for retaining the sharpening members at the first and second angles 116, 118.

The method 1100 may further comprise an additional Step 1104 of clamping the base member to a mounting surface. A clamp 700 can be used for this purpose, as shown in FIG. 8. A Step 1106 includes inserting multiple sharpening members into the elongated depressions, whereby the sharpening members are disposed at angles of about 22° and about 23° relative to the perpendicular plane 136. The sharpening members 110*a-d* may include cylindrical rods having a coarse side 132 and a fine side 134, and diamond coated steel or titanium material composition.

In some embodiments, a Step 1108 comprises attaching a leveling instrument to a blade. The exact angle of the blade 200 is maintained through visual inspection of the leveling instrument 122 while sharpening the blade 200. A Step 1110 includes orienting the blade perpendicular to the first side 104 of the base member 102 through visual verification with the leveling instrument 122. In this manner, the blade 200 receives optimal sharpening when disposed perpendicular to the first side 104 of the base member 102, and while engaging the sharpening members at the first and second angles 116, 118 of about 22° and 23°.

In some embodiments, a Step 1112 may include positioning the hand beneath a hand guard. FIGS. 8 and 11 reference a hand guard 120 that serves as a barrier to protect the hand from being cut by the blades. The hand guard 120 pivots about the first side, serving as a retractable barrier that covers the non-sharpening hand while the sharpening hand draws the blade 200 against sharpening member 110*a*.

A Step 1114 comprises drawing the blade longitudinally across at least one of the sharpening members, whereby the edge of the blade engages the sharpening members at the first angle or the second angle. In operation, the actual sharpening of the blade 200 takes place at a point of contact between the blade 200 and the sharpening members 110*a*, 110*b*. The blade 200 are drawn longitudinally and downwardly, so that the point of contact moves smoothly along cutting edges and bevels of the blade 200. In one embodiment, the edge or bevel of a blade 200 is drawn in a first direction against a first sharpening member 110*a* while remaining perpendicular to the first side 104 of the base member 102. The blade 200 is longitudinally drawn across the first sharpening member 110*a*, so that contact of the blade 200 with the sharpening member 10*a* moves progressively from the knife handle toward the tip 112*a* of the blade 200.

The method 1100 further comprises a final Step 1116 of stowing the sharpening members in the stowage cavity 108 of the base member. The stowage cavity 108 is sized and dimensioned to store the sharpening members 110*a-d* when not being used to sharpen blade 200. This storage capacity can be useful for organizing the sharpening members, or choosing a desired sharpening member from a plurality of sharpening members.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An acute angle blade sharpening apparatus, the apparatus comprising:

a base member having a first side and a second side, the first side forming multiple elongated depressions each oriented between 21 degrees and 23 degrees relative to a perpendicular plane disposed perpendicular to a plane of the first side of the base member;

a first elongated sharpening member defined by a mount end, a body, and a tip, the mount end detachably affixed into a first one of the elongated depressions, the first sharpening member further being defined by a coarse side and a fine side, disposed at a first sharpening angle of about 22° relative to the perpendicular plane, a second elongated sharpening member defined by a mount end, a body, and a tip, the mount end detachably affixed into a second one of the elongated depressions, the second sharpening member further being defined by a coarse side and a fine side, disposed at a second sharpening angle of about 23° relative to the perpendicular plane, whereby a blade positions perpendicular to the plane of the first side of the base member and is drawn against at least one of the first and second sharpening members, a leveling instrument, whereby the leveling instrument is operable to enable attachment to the blade to facilitate maintenance of the blade at a 90° angle relative to the plane of the first side of the base member as the blade is drawn against the first sharpening member and the second sharpening member; and a plurality of springs disposed at the second side of the base member, the springs retaining the first and second sharpening members at the second side when detached from the first and second elongated depressions, respectively.

2. The apparatus of claim 1, further comprising a hand guard hingedly joined with the first side of the base member.

3. The apparatus of claim 1, further comprising a clamp operable to enable mounting the base member to a mounting surface.

4. The apparatus of claim 1, further comprising a fastener operable to enable fastening the leveling instrument to the blade.

5. The apparatus of claim 4, wherein the fastener is a clip.

6. The apparatus of claim 5, wherein leveling instrument is a spirit level.

7. The apparatus of claim 6, wherein the leveling instrument indicates the orientation of the blade relative to the first side of the base member.

8. The apparatus of claim 7, wherein the base member forms a leveling instrument cavity sized and dimensioned to store the leveling instrument and the fastener.

9. The apparatus of claim 1, wherein the base member is a rectangular block.

10. The apparatus of claim 1, wherein the second side of the base member forms a stowage cavity.

11. The apparatus of claim 10, wherein the springs comprises four springs.

12. The apparatus of claim 11, wherein the springs exert a force on the ends of the sharpening members.

13. The apparatus of claim 1, wherein the sharpening members are fabricated from at least one of the following: steel, titanium, diamond, carbide, metal alloys.

14. The apparatus of claim 1, wherein the blade includes at least one of the following: a scissor blade, a knife blade, and a horticulture cutting blade.

15. An acute angle blade sharpening apparatus, the apparatus comprising:

a base member having a first side and a second side, the first side forming multiple elongated depressions each oriented at one of a first angle of about 22 degrees and a second angle of about 23 degrees relative to a perpendicular plane disposed perpendicular to a plane of the first side of the base member, the second side forming a stowage cavity, the base member forming a leveling instrument cavity;

a hand guard hingedly joined with the first side of the base member;

first and second elongated sharpening members each defined by a mount end, a body, and a tip, the mount end detachably affixed into a corresponding one of the elongated depressions, the first and second sharpening members each further being defined by a coarse side and a fine side, whereby the first and second sharpening members are disposed at first and second sharpening angles of about 22 degrees and about 23 degrees, respectively, relative to the perpendicular plane, whereby a blade positions perpendicular to the first side of the base member and is drawn against at least one of the first and second sharpening members;

a leveling instrument, whereby the leveling instrument is operable to enable attachment to the blade to facilitate maintenance of the blade at a 90° angle relative to the plane of the first side of the base member as the blade is drawn against the first and second sharpening members;

a fastener operable to enable fastening the leveling instrument to the blade;

a plurality of springs disposed at the second side of the base member, the springs retaining the first and second sharpening members at the second side when detached from the elongated depressions, respectively; and a clamp operable to enable mounting the base member to a mounting surface.

16. The apparatus of claim 15, wherein the springs exert a force on the ends of the sharpening members.

17. The apparatus of claim 15, wherein the sharpening members are fabricated from at least one of the following: steel, titanium, diamond, carbide, metal alloys.

18. A method for sharpening a blade, the method comprising:

positioning a base member on a flat surface, the base member having a first side and a second side forming a stowage cavity, the first side forming multiple elongated depressions each oriented at one of a first angle of about 22 degrees and a second angle of about 23 degrees relative to a perpendicular plane disposed perpendicular to a plane of the first side of the base member;

clamping the base member to a mounting surface;

inserting first and second sharpening members into respective ones of the elongated depressions, whereby the first and second sharpening members are disposed at a first sharpening angle of about 22 degrees and a second sharpening angle of about 23 degrees, respectively, relative to a perpendicular plane disposed perpendicular to a plane of the first side of the base member;

attaching a leveling instrument to a blade;

orienting the blade perpendicular to the first side of the base member through visual verification with the leveling instrument;

positioning the hand beneath a hand guard;

drawing the blade longitudinally across at least one of the sharpening members while maintaining the blade at a 90° angle relative to the plane of the first side of the base member by visual verification using the leveling instrument, whereby the edge of the blade engages the first and second sharpening members at the first sharpening angle or the second sharpening angle, respectively; and stowing the first and second sharpening members between springs in the second side of the base member.

* * * * *